US009340379B2

(12) United States Patent
Kiuchi

(10) Patent No.: US 9,340,379 B2
(45) Date of Patent: May 17, 2016

(54) FEEDING DEVICE AND RECORDING APPARATUS

(71) Applicant: CANON KABUSHIKI KAISHA, Tokyo (JP)

(72) Inventor: Takahiro Kiuchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/333,409

(22) Filed: Jul. 16, 2014

(65) Prior Publication Data

US 2015/0021851 A1 Jan. 22, 2015

(30) Foreign Application Priority Data

Jul. 19, 2013 (JP) ..... 2013-150364

(51) Int. Cl.

| | |
|---|---|
| ***B65H 3/06*** | (2006.01) |
| ***B65H 1/04*** | (2006.01) |
| ***B65H 1/08*** | (2006.01) |
| ***B65H 5/06*** | (2006.01) |
| ***B65H 9/04*** | (2006.01) |
| ***B65H 9/06*** | (2006.01) |

(52) U.S. Cl.

CPC ..... *B65H 3/0684* (2013.01); *B65H 1/04* (2013.01); *B65H 1/08* (2013.01); *B65H 5/062* (2013.01); *B65H 9/04* (2013.01); *B65H 9/06* (2013.01)

(58) Field of Classification Search

CPC ..... B65H 3/06; B65H 3/0607; B65H 3/0638; B65H 3/0661; B65H 3/0684; B65H 3/66; B65H 2404/132; B65H 2404/1321; B65H 2404/1345; B65H 2511/12; B65H 5/062; B65H 1/04; B65H 9/04; B65H 1/08; B65H 9/06

USPC ..... 271/117, 118, 171

See application file for complete search history.

(56) References Cited

U.S. PATENT DOCUMENTS

| | | | | |
|---|---|---|---|---|
| 5,527,026 | A | 6/1996 | Padget | |
| 5,848,786 | A * | 12/1998 | Holland-Letz et al. | 271/110 |
| 5,938,189 | A * | 8/1999 | Holland-Letz et al. | 271/152 |
| 5,971,390 | A * | 10/1999 | Caspar et al. | 271/121 |
| 6,170,817 | B1 * | 1/2001 | Kawaguchi | 271/167 |
| 6,206,367 | B1 * | 3/2001 | Jo | 271/264 |
| 6,352,256 | B1 * | 3/2002 | Hsieh | 271/110 |
| 8,061,704 | B1 * | 11/2011 | Blair et al. | 271/117 |

(Continued)

FOREIGN PATENT DOCUMENTS

| | | |
|---|---|---|
| CN | 1054751 A | 9/1991 |
| CN | 1115720 A | 1/1996 |

(Continued)

*Primary Examiner* — David H Bollinger

(74) *Attorney, Agent, or Firm* — Canon USA Inc. IP Division

(57) ABSTRACT

A feeding device includes a loading unit for loading a sheet, a feeding roller section that has a shaft member on which a first roller and a second roller are disposed, and that feeds the sheet, and a holding member that holds the feeding roller section such that the first and second rollers are moved to a contact position where the first and second rollers are in contact with the sheet loaded on the loading unit and a separate position where the first and second rollers are separated from the sheet loaded on the loading unit. When the width of the sheet is less than or equal to a predetermined length, the first roller is in contact with the sheet whereas the second roller is not in contact with the sheet. The loading unit has a hole provided at a position opposite to the second roller.

8 Claims, 8 Drawing Sheets

(56) References Cited

U.S. PATENT DOCUMENTS

| | | | | |
|---|---|---|---|---|
| 2005/0168501 | A1* | 8/2005 | Okuda et al. | 346/104 |
| 2005/0285327 | A1* | 12/2005 | Suzuki et al. | 271/109 |
| 2007/0102867 | A1* | 5/2007 | Leemhuis et al. | 271/117 |

FOREIGN PATENT DOCUMENTS

| | | | |
|---|---|---|---|
| JP | H11-334889 | A | 12/1999 |
| JP | 2008-013334 | A | 1/2008 |
| WO | 95/25057 | A1 | 9/1995 |

* cited by examiner

FEEDING DEVICE AND RECORDING APPARATUS

BACKGROUND OF THE INVENTION

1. Field of the Invention

The present invention relates to a feeding device that feeds a sheet and to a recording apparatus that performs recording on a sheet with a recording head.

2. Description of the Related Art

Forms of a feeding mechanism for a recording apparatus include a form of swing arm type in which a feeding roller section is provided at one end of a pendulum member that is pivotally supported on a fixed shaft at the other end. The feeding roller section has a driving roller that comes into contact with a recording medium (sheets). In the swing arm type, the pendulum member can swing, and therefore a recording medium loaded on a loading unit is pressed and held by the driving roller of the feeding roller section. In a paper feeding device of U.S. Pat. No. 5,527,026 (Patent Literature 1), when there are no sheets in a stationary tray, a driving roller is in contact with a roller provided in the bottom surface of the stationary tray.

In a recording apparatus of Japanese Patent Laid-Open No. 2008-013334 (Patent Literature 2), a feeding roller swings relative to a swing arm to equalize, and the feeding roller is brought into press-contact with a sheet on a sheet loading surface. The direction of the rotation axis of the feeding roller is perpendicular to the conveying direction of the sheet, and therefore the sheet can be prevented from being conveyed in a skew state.

In a feeding device having two rollers in its feeding roller section, when the width of a sheet is small, only one of the rollers is in contact with the sheet. In this case, if the other roller not in contact with the sheet is in contact with a driven roller as in Patent Literature 1, the feeding force of the feeding roller section is transmitted to the driven roller, and feeding force that feeds the sheet decreases. If the pressure that holds the recording medium during feeding decreases, the feeding force decreases as well, the roller of the feeding roller section may slip, and the recording medium may not be fed.

SUMMARY OF THE INVENTION

In view of such circumstances, the present invention provides a feeding device that stably feeds different-sized sheets.

In an aspect of the present invention, a feeding device includes (1) a loading unit for loading a recording medium, (2) a feeding roller section having a shaft member on which a first roller and a second roller are disposed, and configured to feed the recording medium, and (3) a holding member that holds the feeding roller section such that the first roller and the second roller are moved to (3-1) a contact position where the first roller and the second roller are in contact with the recording medium loaded on the loading unit and (3-2) a separate position where the first roller and the second roller are separated from the recording medium loaded on the loading unit. (A) When the width of the recording medium is less than or equal to a predetermined length, the first roller is in contact with the recording medium whereas the second roller is not in contact with the recording medium. (B) The holding member equalizably holds the shaft member such that when the first roller and the second roller come into contact with the recording medium, the first roller and the second roller conform to the recording medium. (C) The loading unit has a hole provided at a position opposite to the second roller.

Further features of the present invention will become apparent from the following description of exemplary embodiments with reference to the attached drawings.

DESCRIPTION OF THE EMBODIMENTS

A recording apparatus having a feeding device according to an embodiment of the present invention will now be described with reference to the drawings.

First Embodiment

Figure 1:
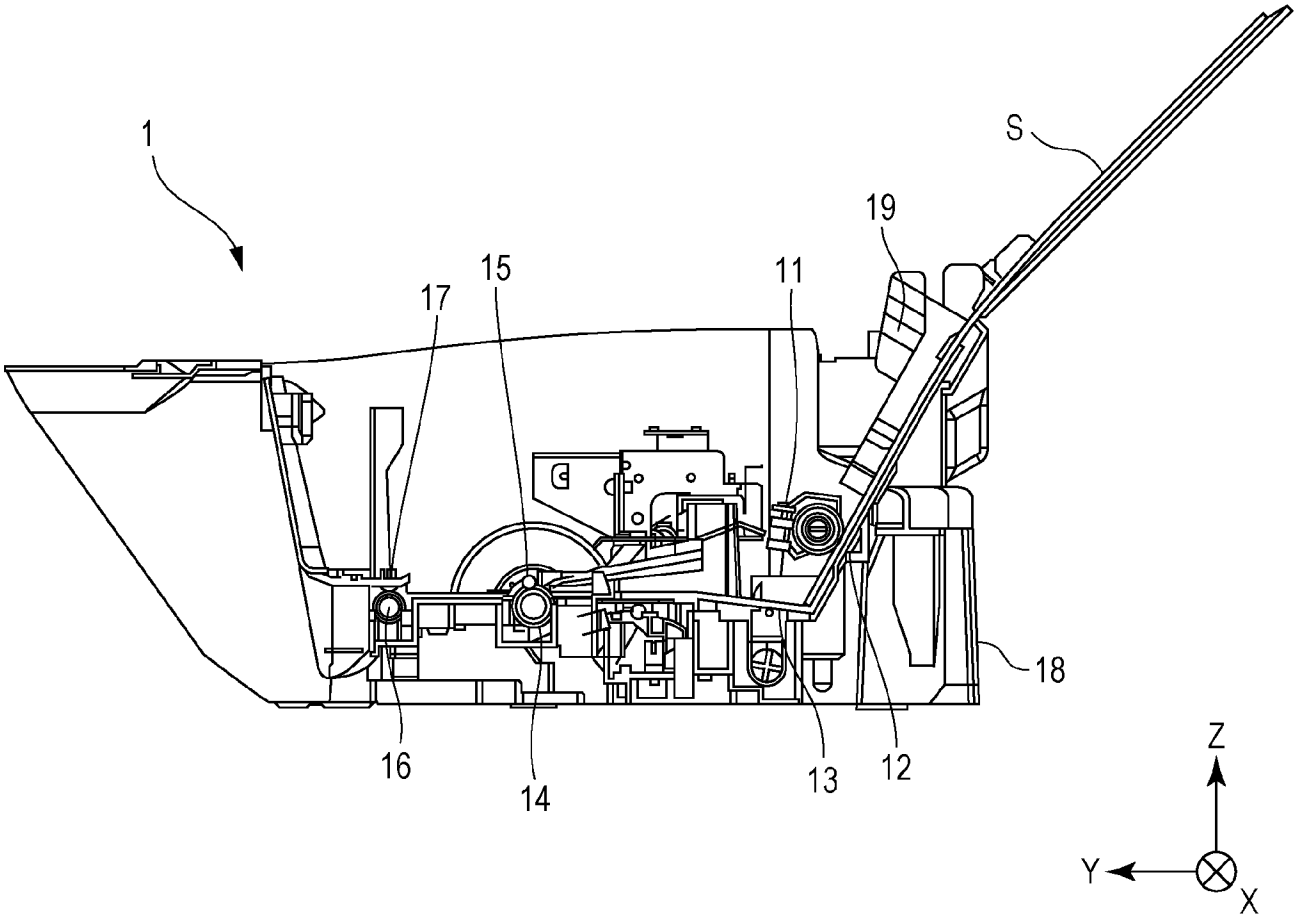
FIG. 1 shows the configuration of a section of a recording apparatus of an embodiment of the present invention.

FIG. 1 shows a sectional view of a recording apparatus 1. A sheet S loaded on a loading unit 12 is fed by a first roller 52 and a second roller 53 described later. The sheet S is a recording medium. The first roller 52 and the second roller 53 are provided in a feeding roller section 51 described later. The feeding roller section 51 has a shaft member that holds the first roller 52 and the second roller 53. A swing arm 11 is a holding member that holds the feeding roller section 51 such that the feeding roller section 51 can perform equalizing operation, and is swingably supported by a case 18 of the recording apparatus 1. The swing arm 11 swings the feeding roller section 51 to a contact position where the feeding roller section 51 is in contact with the sheet S loaded on the loading unit 12 and a separate position where the feeding roller section 51 is separate from the sheet S loaded on the loading unit 12. The swing arm 11 may move between the contact position and the separate position without swinging. For example, the swing arm 11 may linearly move between the contact position and the separate position of the recording apparatus 1. The case 18 is formed integrally with the loading unit 12.

The sheet S fed by the first roller 52 and the second roller 53 is fed to the nip portion between a conveying roller 14 and a conveying pinch roller 15. Correcting operation is performed in which the leading edge of the sheet S is aligned with the nip portion. That is, the skew correction of the sheet S is performed. The conveying pinch roller 15 is a driven roller driven by the conveying roller 14.

Next, the sheet S is conveyed to a recording position of a recording unit of a carriage B13 described later, and recording operation is performed. After the recording operation, the sheet S is nipped between an ejecting roller 16 and an ejecting pinch roller 17 driven by the ejecting roller 16, and is ejected to the outside of the recording apparatus 1.

Figure 2:
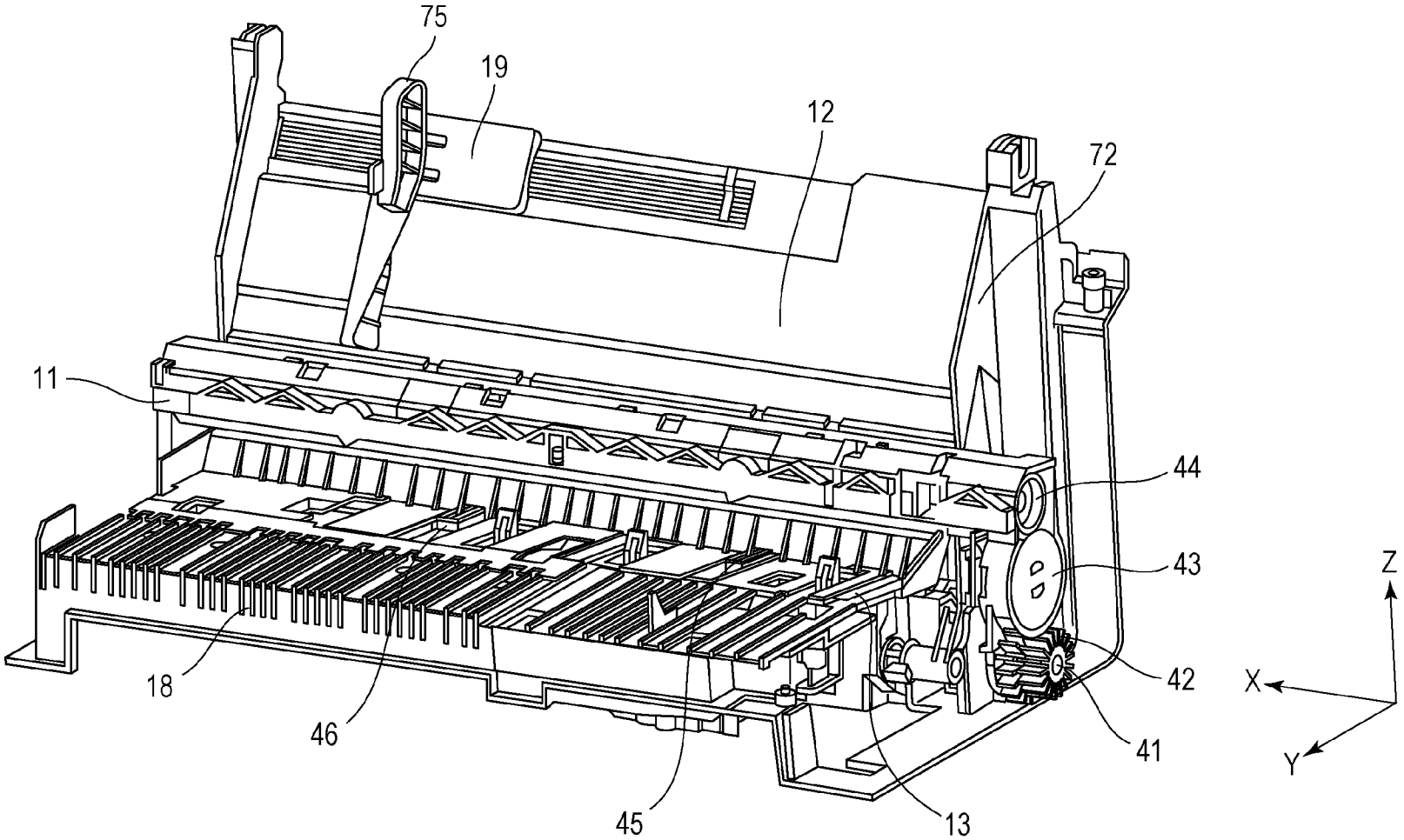
FIG. 2 shows the configuration inside the recording apparatus.

FIG. 2 shows the configuration inside the recording apparatus 1. The swing arm 11 that is a holding member is swingably attached to a swing arm supporting shaft 41. The swing arm 11 is configured such that the first roller 52 and the second roller 53 provided in the feeding roller section 51 described later can be in press-contact with the sheet S loaded on the loading unit 12.

A shaft gear 44 is inserted into the inside of the feeding roller section 51, and transmits driving to the feeding roller section 51 substantially in the middle of the feeding roller section 51. Feeding gears 42 and 43 transmit driving to the shaft gear 44. A first separation unit 45 (first abutting member) and a second separation unit 46 (second abutting member) are installed on a separation bank 13.

A stationary guide 72 is fixed to the first roller 52 side of the loading unit 12. By bringing the side edge of the sheet S into contact with the stationary guide 72, the sheet S can be guided and placed at a predetermined position on the loading unit 12. A movable guide 75 is provided on the second roller 53 side of the loading unit 12. The movable guide 75 is movable on the loading unit 12 in a direction intersecting with the feeding direction of the sheet S. The movable guide 75 is moved according to the width of the sheet S, and the side edge of the sheet S is guided to and brought into contact with the movable guide 75. By bringing both side edges of the sheet S into contact with the stationary guide 72 and the movable guide 75, the sheet S can be fixed to the predetermined position on the loading unit 12. Therefore, the stationary guide 72 and the movable guide 75 can be brought into contact with the side edges of the sheet S.

Figure 3:
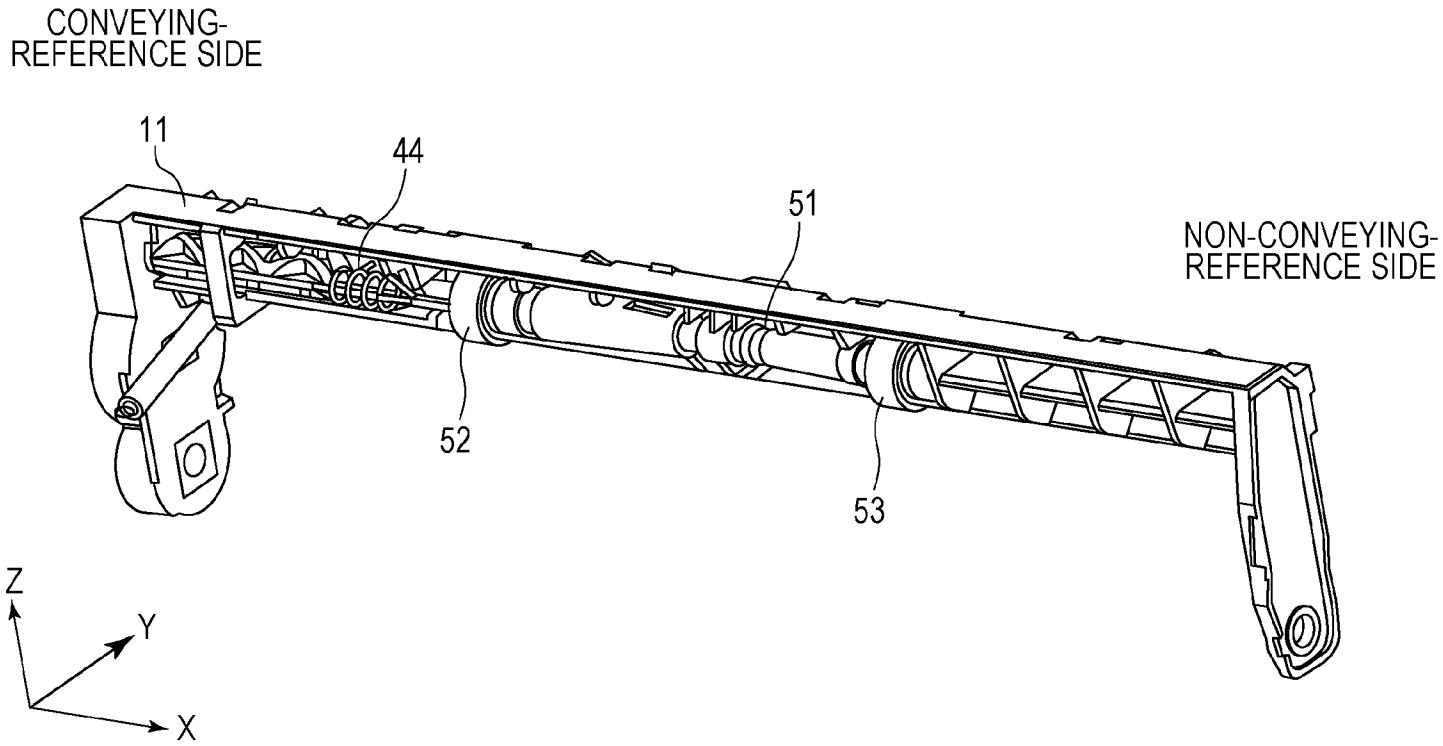
FIG. 3 shows a swing arm unit.

FIG. 3 shows a swing arm unit of the swing arm 11. The first roller 52 and the second roller 53 are provided at both ends of the feeding roller section 51. The first roller 52 side is a conveying-reference side on which the stationary guide 72 is disposed with which the side edge of the fed sheet S is brought into contact, and that is used as a reference for placing the sheet S at the predetermined position. The first roller 52 and the second roller 53 rotate in contact with the sheet S loaded on the loading unit 12, and thereby perform feeding operation in which the sheet S is fed. The first roller 52 and the second roller 53 rotate with the rotation of the feeding roller section 51.

The first roller 52 can be always in contact with the sheet S loaded on the loading unit 12 regardless of the length of the width of the sheet S that is the length in a direction intersecting with the feeding direction in which the sheet S is fed. When the width of the sheet S is less than or equal to a predetermined length, the first roller 52 is in contact with the sheet S whereas the second roller 53 is not in contact with the sheet S. Here, the predetermined length may be the distance between the stationary guide 72 and the second roller 53.

Figure 4:
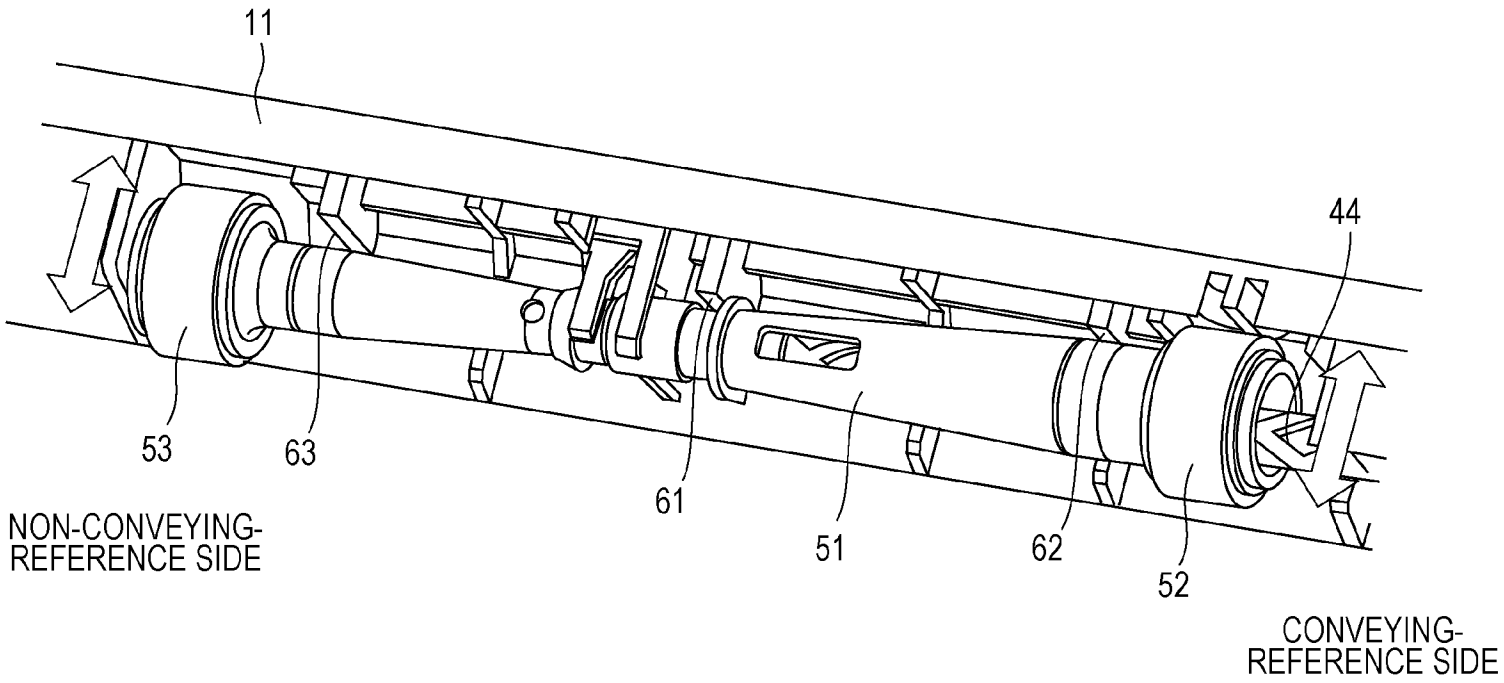
FIG. 4 shows an equalizing mechanism of a feeding roller section.

FIG. 4 shows an equalizing mechanism of the feeding roller section 51. FIG. 4 is a view of a section of the swing arm of FIG. 3 intersecting with the feeding direction as viewed from the downstream side in the feeding direction. The feeding roller section 51 is attached to the swing arm 11 such that the feeding roller section 51 can swing in the arrow direction in FIG. 4 to equalize. That is, the feeding roller section 51 can equalize in the thickness direction of the sheet loaded on the loading unit 12.

The feeding roller section 51 can swing with a supporting surface 61 as a fulcrum until the feeding roller section 51 abuts on a first abutting surface 62 provided on the first roller 52 side or a second abutting surface 63 provided on the second roller 53 side. The supporting surface 61 is located substantially in the middle of the feeding roller section 51. Since the feeding roller section 51 swings in this manner, the feeding force of the feeding roller section 51 is equally distributed to the first roller 52 and the second roller 53, and excessive feeding force can be prevented from being distributed to the first roller 52 or the second roller 53. As a result, the skew of the fed sheet S can be prevented, and a roller mark can be prevented from being left on the sheet S owing to excessive feeding force.

Figure 5:
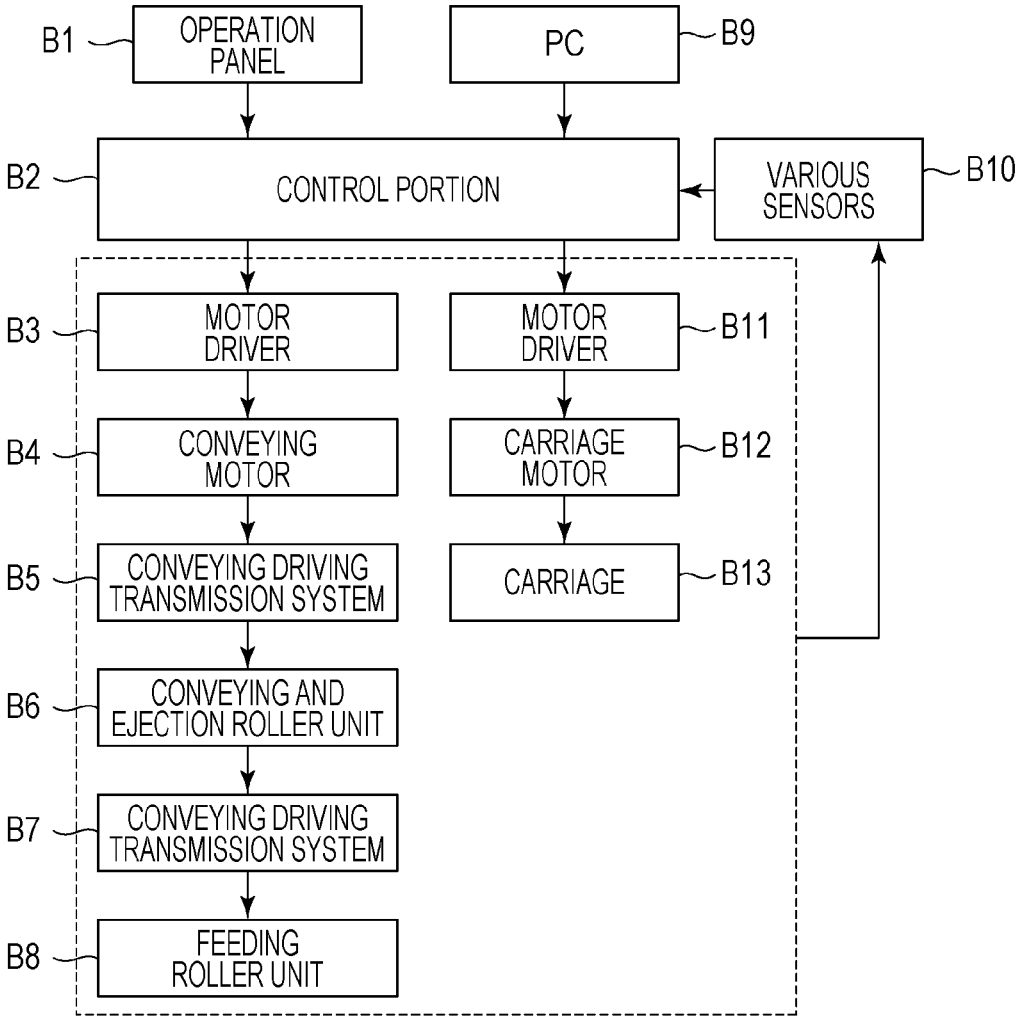
FIG. 5 is a block diagram showing the configuration of a control circuit.

FIG. 5 shows a block diagram of the configuration of a control circuit of the recording apparatus 1. A control portion B2 outputs a signal for controlling a motor to each of motor drivers B3 and B11 according to signals input from an operation panel B1 and a PC B9.

A conveying motor B4 drives a conveying and ejection roller unit B6 and a feeding roller unit B8 through a conveying driving transmission system B5 and a conveying driving transmission system B7 according to a signal input from the motor driver B3. By the driving of the conveying motor B4, the conveying and ejection roller unit B6, and the feeding roller unit B8, the conveying roller 14, the ejecting roller 16, and the feeding roller section 51 are respectively driven.

A carriage motor B12 drives a carriage B13 according to a signal input from the motor driver B11. Various sensors B10 detect the position of the sheet S, the rotational amount of the conveying roller 14, the position of the carriage B13, and the like, and input detected detection signals to the control portion B2. On the basis of the detection signals input from the various sensors B10, the control portion B2 transmits appropriate control signals to the motor driver B3 and the motor driver B11 again. The various sensors B10 are provided in a region where the sheet S is conveyed or a region where recording on the sheet S is performed.

Figure 6:
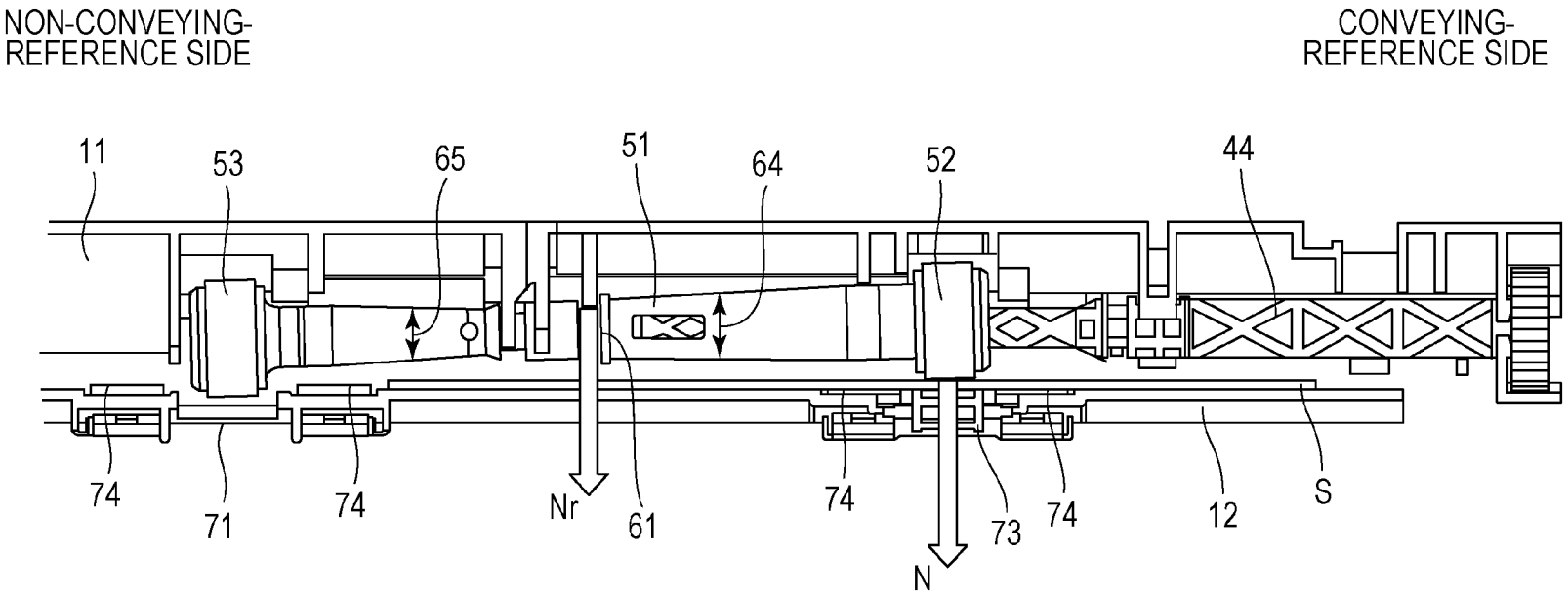
FIG. 6 is a view of a state where a sheet having a width less than or equal to a predetermined length is fed.

FIG. 6 is a view of a state where a sheet S having a width less than or equal to the predetermined length is fed as viewed from the downstream side in the feeding direction. At this time, the first roller 52 provided on the stationary guide 72 side is in contact with the sheet S whereas the second roller 53 provided at a position further from the stationary guide 72 than the first roller 52 is not in contact with the sheet S. The feeding roller section 51 can swing around the supporting surface 61. Therefore, when a sheet S having a width less than or equal to the predetermined length is fed, feeding by the feeding roller section 51 is performed with the feeding roller section 51 tilted to the limit.

The loading unit 12 has a hole 71 provided at a position opposite to the second roller 53. When the feeding roller section 51 is tilted to the limit, the second roller 53 enters the hole 71 and is not in contact with the loading unit 12.

When a sheet S having a width less than or equal to the predetermined length is fed, the second roller 53 enters the hole 71 and thereby rotates idly without being in contact with any member. Therefore, the feeding force transmitted from the swing arm 11 to the feeding roller section 51 is not applied through the second roller 53 to any member nor to the sheet S. The first roller 52 in contact with the sheet S can hold the sheet S with almost all of the feeding force imparted from the swing arm 11. Therefore, feeding pressure that is the pressure during the feeding of the sheet S can be sufficiently secured.

The shaft gear 44 is configured to be held by the swing arm 11 and the feeding roller section 51 and not to be in contact with the other members. Therefore, the feeding force imparted from the swing arm 11 to the sheet S by the shaft gear 44 does not decrease.

The swing arm 11 is not brought into contact with members other than the feeding roller section 51, the shaft gear 44, the feeding gears 42 and 43, and the swing arm supporting shaft 41 by swinging. Therefore, almost all of the feeding force transmitted to the swing arm 11 is transmitted to the feeding roller section 51.

Figure 7:
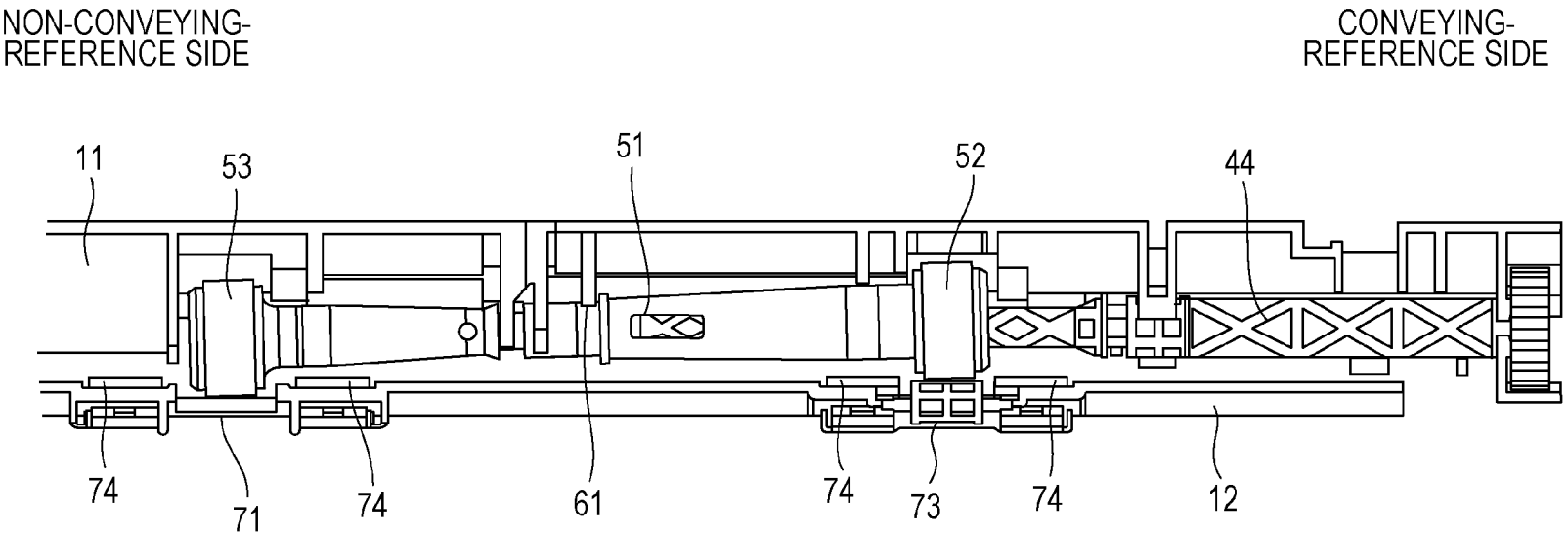
FIG. 7 shows a state where no sheet is loaded on a loading unit.

FIG. 7 is a view of sections of the loading unit 12 and the swing arm of FIG. 3 intersecting with the feeding direction (conveying direction) as viewed from the downstream side in the feeding direction. Reference numeral 73 denotes a driven roller provided in a part of the loading unit 12 opposite to the first roller 52. In a state where the sheet S is not loaded on the loading unit 12, the first roller 52 is in contact with the driven roller 73. In this state, when the first roller 52 rotates, the driven roller 73 also rotates in accordance with the rotation of the first roller 52. The second roller 53 enters the hole 71 and is not in contact with other members such as the loading unit 12. That is, the second roller 53 rotates idly. As described above, the rotation of the first roller 52 and the second roller 53 is not significantly interfered with, and therefore the generation of excessive friction between the first roller 52 and the second roller 53 and other members can be prevented. If excessive friction is generated between the first roller 52 and the second roller 53 and other members, the first roller 52 and the second roller 53 are worn, and an overload of the motor occurs.

Instead of the driven roller 73, a hole 71 may be provided in the part of the loading unit 12 opposite to the first roller 52.

Figure 8:
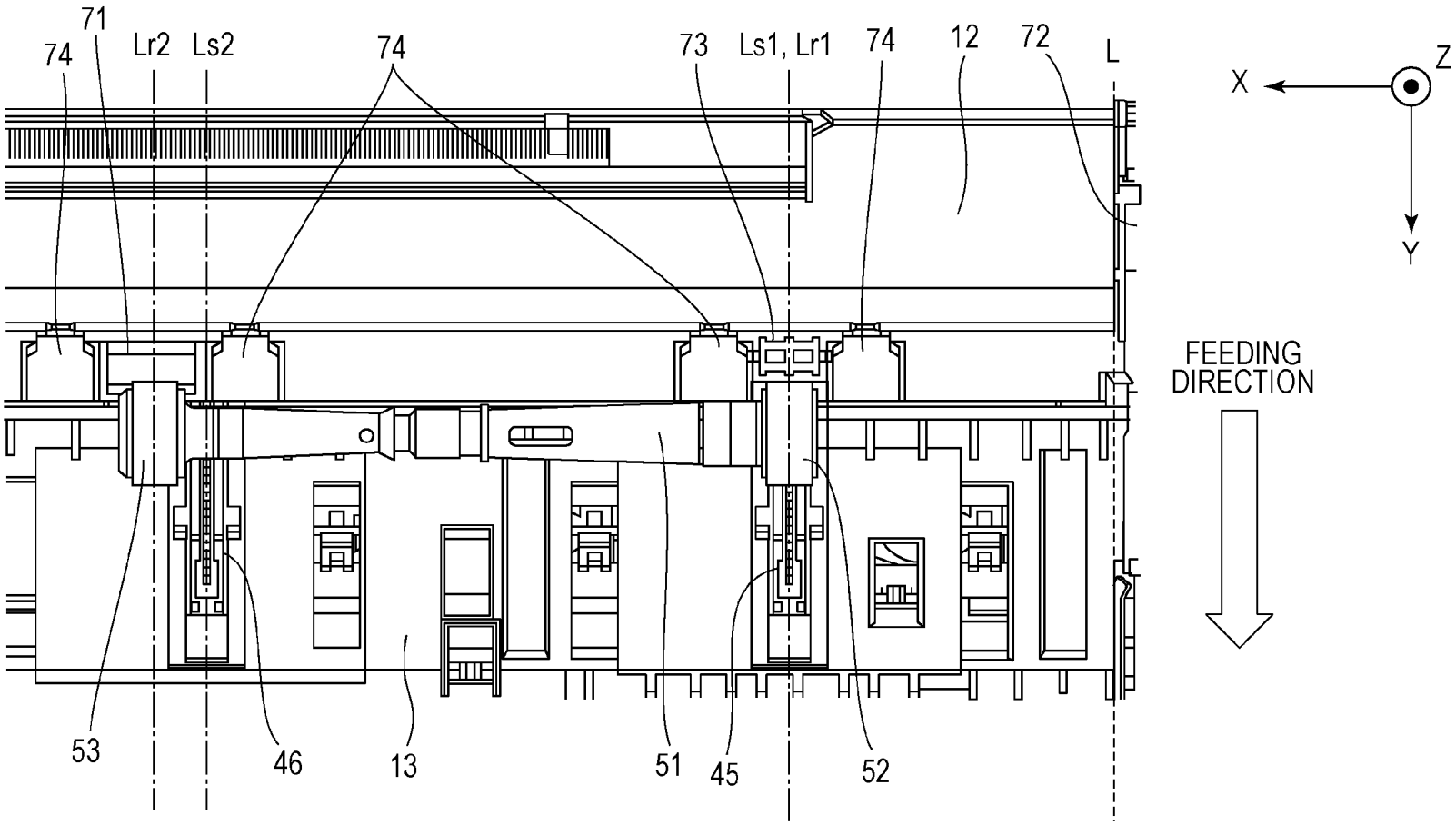
FIG. 8 shows the configuration of the loading unit and a separation portion.

FIG. 8 shows the configuration of the loading unit and a separation portion. The separation bank 13 is attached to the case 18. The separation bank 13 is provided with the first separation unit 45 and the second separation unit 46, and the first separation unit 45 is disposed at a position corresponding to the first roller 52. The first separation unit 45 and the second separation unit 46 are held by the separation bank 13.

The first separation unit 45 (first abutting member) and the second separation unit 46 (second abutting member) have wavelike shapes on their contact surfaces that come into contact with the sheet S. The sheet S is conveyed such that the leading edge of the sheet S abuts on the wavelike shapes of the first separation unit 45 and the second separation unit 46. The first separation unit 45 and the second separation unit 46 impart resistance to the fed sheet S, thereby separating the sheet S.

A reference line L is defined as a straight line passing through the stationary guide 72 and parallel to the feeding direction of the sheet S. A straight line passing through the center in the width direction of the first separation unit 45 and parallel to the reference line L is denoted as Ls1. A straight line passing through the center in the width direction of the second separation unit 46 and parallel to the reference line L is denoted as Ls2. A straight line passing through the center in the width direction of the first roller 52 and parallel to the reference line L is denoted as Lr1. A straight line passing through the center in the width direction of the second roller 53 and parallel to the reference line L is denoted as Lr2.

Ls1 and Lr1 coincide with each other. That is, the first separation unit 45 is provided at a position corresponding to the first roller 52 in the width direction of the sheet S. Ls2 is closer to the reference line L than Lr2. That is, the second separation unit 46 is provided at a position corresponding to a part of the feeding roller section 51 between the first roller 52 and the second roller 53 in the width direction of the sheet S. As described above, the first separation unit 45 and the second separation unit 46 are located on the inner side of the first roller 52 and the second roller 53, and therefore a sheet S having a width greater than the predetermined length and conveyed in contact with the first roller 52 and the second roller 53 can be prevented from deviating from the feeding direction.

In a case where a sheet S having a width less than or equal to the predetermined length, only the first roller 52 is in contact with the sheet S, and the sheet S is fed. In this case, if the straight line Ls1 and the straight line Lr1 do not coincide with each other, the sheet S is rotated by force applied from the first separation unit 45 to the leading edge of the sheet S. For this reason, Ls1 and Lr1 coincide with each other in the width direction of the sheet S.

In general, the resistance imparted from a separation unit to a sheet when a straight line passing through the center in the width direction of a roller and parallel to the feeding direction and a straight line passing through the center in the width direction of the separation unit and parallel to the feeding direction coincide with each other is larger than that when the straight lines do not coincide with each other. Therefore, the feeding pressure on the sheet S in a state where Ls1 and Lr1 coincide with each other is higher than the feeding pressure in a state where Ls1 and Lr1 do not coincide with each other.

According to the present invention, when the width of a sheet (recording medium) is less than or equal to the predetermined length, the second roller not in contact with the sheet enters the hole provided in the loading unit and is thereby out of contact with the loading unit. Therefore, a feeding device that stably feeds different-sized sheets can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-150364 filed Jul. 19, 2013, which is hereby incorporated by reference herein in its entirety.

What is claimed is:

1. A feeding device comprising:

a loading unit having a loading surface for loading a recording medium;

a feeding portion capable of feeding the recording medium loaded on the loading surface, the feeding portion including, a shaft member that has a rotation axis disposed essentially parallel to the loading surface and that is rotatable about the rotation axis, a first roller arranged on one end side of the shaft member, and a second roller arranged on the other end side of the shaft member; and a holding member including a supporting surface to swingably support the shaft member at a position between the first roller and the second roller such that when the first roller moves away from the loading surface, the second roller moves toward the loading surface by using the supporting surface as a fulcrum, wherein, the loading surface is configured to include a hole formed at a position opposite to the second roller, and allow at least a part of the second roller to enter into the hole.

2. The feeding device according to claim 1, wherein when the width of the recording medium is less than or equal to the predetermined length, the second roller enters the hole and is not in contact with the loading unit.

3. The feeding device according to claim 1, further comprising a stationary guide disposed on the first roller side of the loading unit and guiding one side edge of the recording medium, and a movable guide movably disposed on the loading unit and guiding the other side edge of the recording medium.

4. The feeding device according to claim 3, wherein the predetermined length is the distance between the stationary guide and the second roller.

5. The feeding device according to claim 1, further comprising a driven roller disposed in a part of the loading unit opposite to the first roller and driven by the first roller.

6. The feeding device according to claim 1, further comprising a first abutting member that is disposed at a position corresponding to the first roller in the width direction of the recording medium and on the downstream side of the first roller in a feeding direction of the recording medium and that abuts on the leading edge of the recording medium.

7. The feeding device according to claim 6, further comprising a second abutting member that is disposed between the first roller and the second roller in the width direction of the recording medium and on the downstream side of the first roller in the feeding direction and that abuts on the leading edge of the recording medium.

8. A recording apparatus comprising:

a recording portion having a recording head performing recording on a recording medium;

a loading unit having a loading surface for loading the recording medium;

a feeding portion capable of feeding the recording medium loaded on the loading surface to the recording portion, the feeding portion including, a shaft member that has a rotation axis disposed essentially parallel to the loading surface and that is rotatable about the rotation axis, a first roller fixed to one end of the shaft member, and a second roller fixed to the other end of the shaft member; and a holding member including a supporting surface to swingably support the shaft member at a position between the first roller and the second roller such that when the first roller moves away from the loading surface, the second roller moves toward the loading surface by using the supporting surface as a fulcrum, wherein, the loading surface is configured to include a hole formed at a position opposite to the second roller, and allow at least a part of the second roller to enter into the hole.

* * * * *